US011152694B2

(12) United States Patent
Lin et al.

(10) Patent No.: US 11,152,694 B2
(45) Date of Patent: Oct. 19, 2021

(54) ANTENNA DEVICE

(71) Applicant: InnoLux Corporation, Miao-Li County (TW)

(72) Inventors: Yi-Hung Lin, Miao-Li County (TW); Chih-Chi Chen, Miao-Li County (TW); Tang-Chin Hung, Miao-Li County (TW); I-Yin Li, Miao-Li County (TW)

(73) Assignee: INNOLUX CORPORATION, Miao-Li County (TW)

( * ) Notice: Subject to any disclaimer, the term of this patent is extended or adjusted under 35 U.S.C. 154(b) by 135 days.

(21) Appl. No.: 16/543,798

(22) Filed: Aug. 19, 2019

(65) Prior Publication Data

US 2020/0091596 A1 Mar. 19, 2020

Related U.S. Application Data

(60) Provisional application No. 62/731,144, filed on Sep. 14, 2018.

(30) Foreign Application Priority Data

Apr. 18, 2019 (CN) ..... 201910313522.X

(51) Int. Cl.
*H01Q 1/36* (2006.01)

(52) U.S. Cl.
CPC ..... *H01Q 1/364* (2013.01)

(58) Field of Classification Search
CPC ..... H01L 27/1255; H01L 21/28556; H01L 23/66; H01L 2223/6677; H01L 2223/6627;

(Continued)

(56) References Cited

U.S. PATENT DOCUMENTS

2018/0026374 A1 1/2018 Chen et al.
2018/0182782 A1* 6/2018 Zhou ..... H01L 21/02592
2020/0043957 A1* 2/2020 Katayama ..... H01Q 3/44

FOREIGN PATENT DOCUMENTS

CN 107658547 A 2/2018
WO 2018/066503 A1 4/2018

OTHER PUBLICATIONS

Chinese language office action dated Sep. 29, 2020, issued in application No. CN 201910313522.X.

(Continued)

*Primary Examiner* — Renan Luque
(74) *Attorney, Agent, or Firm* — McClure, Qualey & Rodack, LLP

(57) ABSTRACT

An antenna device is provided. The antenna device includes a first substrate, a first conductive layer, a second substrate, a liquid-crystal layer, a buffer layer, and an alignment layer. The first conductive layer is disposed on the first substrate, and the first conductive layer has an opening. The second substrate is disposed opposite to the first substrate. The second conductive layer is disposed on the second substrate. The liquid-crystal layer is disposed between the first conductive layer and the second conductive layer. The buffer layer is disposed in the opening and adjacent to an overlapping region of the first conductive layer and the second conductive layer. The alignment layer is disposed between the first conductive layer and the liquid-crystal layer.

20 Claims, 5 Drawing Sheets

(58) Field of Classification Search
CPC ... H01L 27/124; H01L 27/1259; C09K 19/56; H01Q 3/34; H01Q 21/0012; H01Q 3/44; H01Q 1/364; G02F 1/133; G02F 1/1337
See application file for complete search history.

(56) References Cited

OTHER PUBLICATIONS

European Search Report dated Jan. 30, 2020, issued in application No. EP 19195743.0.

* cited by examiner

ANTENNA DEVICE

CROSS REFERENCE TO RELATED APPLICATIONS

This application claims priority of U.S. Provisional Patent Application No. 62/731,144, filed on Sep. 14, 2018, and Chinese Patent Application 201910313522.X, filed on Apr. 18, 2019 the entirety of which are incorporated by reference herein.

BACKGROUND

Technical Field

The present disclosure relates to an electronic device, and in particular it relates to an antenna device with stable capacitance.

Description of the Related Art

Electronic products that come with a display panel, such as smartphones, tablets, notebooks, monitors, and TVs, have become indispensable necessities in modern society. With the flourishing development of such portable electronic products, consumers have high expectations regarding the quality, functionality, or price of such products. Such electronic products can generally be used as electronic modulation devices as well, for example, as antenna devices that can modulate electromagnetic waves.

Although currently existing antenna devices have been adequate for their intended purposes, they have not been satisfactory in all respects. The development of an antenna device that can effectively maintain capacitance modulation stability or operational reliability is still one of the goals that the industry currently aims for.

SUMMARY

In accordance with some embodiments of the present disclosure, an antenna device is provided. The antenna device includes a first substrate, a first conductive layer, a second substrate, a liquid-crystal layer, a buffer layer and an alignment layer. The first conductive layer is disposed on the first substrate, and the first conductive layer has an opening. The second substrate is disposed opposite to the first substrate. The second conductive layer is disposed on the second substrate. The liquid-crystal layer is disposed between the first conductive layer and the second conductive layer. The buffer layer is disposed in the opening and adjacent to an overlapping region of the first conductive layer and the second conductive layer. The alignment layer is disposed between the first conductive layer and the liquid-crystal layer.

In accordance with some other embodiments of the present disclosure, an antenna device is provided. The antenna device includes a first substrate, a first conductive layer, a second substrate, a second conductive layer, a liquid-crystal layer, a stopper structure and an alignment layer. The first conductive layer is disposed on the first substrate, and the first conductive layer has a first edge. The second substrate is disposed opposite to the first substrate. The second conductive layer is disposed on the second substrate. The first edge is aligned with a second edge of an overlapping region of the first conductive layer and the second conductive layer. The liquid-crystal layer is disposed between the first conductive layer and the second conductive layer. The stopper structure is disposed on the first edge. The alignment layer is disposed between the first conductive layer and the liquid-crystal layer A detailed description is given in the following embodiments with reference to the accompanying drawings.

BRIEF DESCRIPTION OF THE DRAWINGS

The disclosure may be more fully understood by reading the subsequent detailed description and examples with references made to the accompanying drawings, wherein.

DETAILED DESCRIPTION

Figure 1:
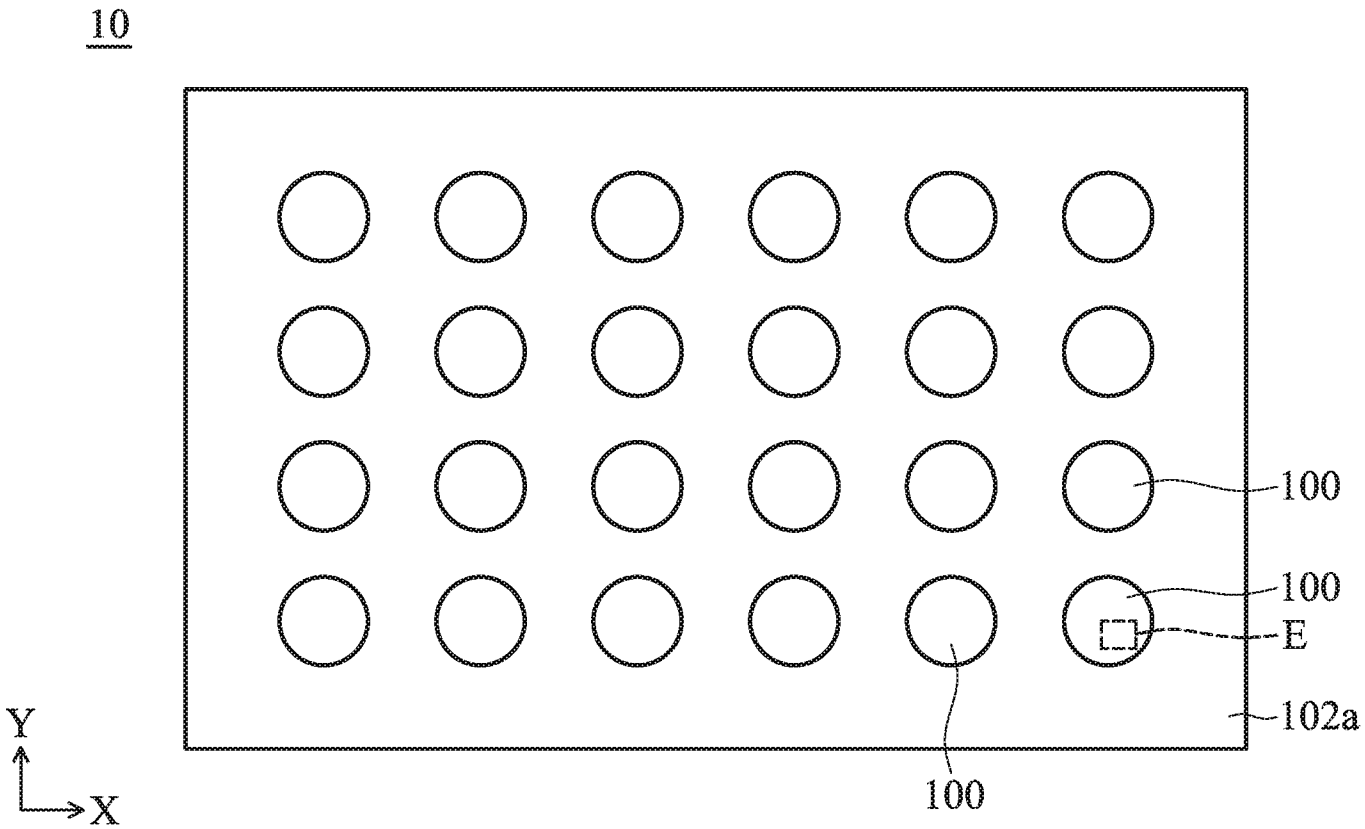
FIG. 1 illustrates the top-view diagram of the electronic device in accordance with some embodiments of the present disclosure.

The structure of the electronic device of the present disclosure and the manufacturing method thereof are described in detail in the following description. In the following detailed description, for purposes of explanation, numerous specific details and embodiments are set forth in order to provide a thorough understanding of the present disclosure. The specific elements and configurations described in the following detailed description are set forth in order to clearly describe the present disclosure. It will be apparent, however, that the exemplary embodiments set forth herein are used merely for the purpose of illustration, and the inventive concept may be embodied in various forms without being limited to those exemplary embodiments. In addition, the drawings of different embodiments may use like and/or corresponding numerals to denote like and/or corresponding elements in order to clearly describe the present disclosure. However, the use of like and/or corresponding numerals in the drawings of different embodiments does not suggest any correlation between different embodiments.

It should be noted that the elements or devices in the drawings of the present disclosure may be present in any form or configuration known to those with ordinary skill in the art. In addition, in the embodiments, relative expressions are used. For example, "lower", "bottom", "higher" or "top" are used to describe the position of one element relative to another. It should be appreciated that if a device is flipped upside down, an element that is "lower" will become an element that is "higher". It should be understood that the descriptions of the exemplary embodiments are intended to be read in connection with the accompanying drawings, which are to be considered part of the entire written description. The drawings are not drawn to scale. In addition, structures and devices are shown schematically in order to simplify the drawing.

It should be understood that, although the terms first, second, third etc. may be used herein to describe various elements, components, regions, layers, portions and/or sections, these elements, components, regions, layers, portions and/or sections should not be limited by these terms. These terms are only used to distinguish one element, component, region, layer, portion or section from another region, layer or section. Thus, a first element, component, region, layer, portion or section discussed below could be termed a second element, component, region, layer, portion or section without departing from the teachings of the present disclosure.

The terms "about" and "substantially" typically mean +/−20% of the stated value, more typically +/−10% of the stated value, more typically +/−5% of the stated value, more typically +/−3% of the stated value, more typically +/−2% of the stated value, more typically +/−1% of the stated value and even more typically +/−0.5% of the stated value. The stated value of the present disclosure is an approximate value. When there is no specific description, the stated value includes the meaning of "about" or "substantially". Furthermore, the phrase "in a range between a first value and a second value" or "in a range from a first value to a second value" indicates that the range includes the first value, the second value, and other values between them.

In addition, in some embodiments of the present disclosure, terms concerning attachments, coupling and the like, such as "connected" and "interconnected," refer to a relationship wherein structures are secured or attached to one another either directly or indirectly through intervening structures, as well as both movable or rigid attachments or relationships, unless expressly described otherwise.

Unless defined otherwise, all technical and scientific terms used herein have the same meaning as commonly understood by one of ordinary skill in the art to which this disclosure belongs. It should be appreciated that, in each case, the term, which is defined in a commonly used dictionary, should be interpreted as having a meaning that conforms to the relative skills of the present disclosure and the background or the context of the present disclosure, and should not be interpreted in an idealized or overly formal manner unless so defined.

In accordance with some embodiments of the present disclosure, an electronic device (e.g., an antenna device) is provided. The electronic device has an alignment layer with uniform thickness in a portion corresponding to the capacitance adjustable area, thereby the stability of the capacitance value or the operational reliability of the device can be maintained.

Refer to FIG. 1, which illustrates a top-view diagram of an electronic device 10 in accordance with some embodiments of the present disclosure. It should be understood that only some of the components of the electronic device 10 are shown in FIG. 1 and other components are omitted for clarity of illustration. The structure of other components will be described in detail in the following figures. In accordance with some embodiments of the present disclosure, additional features may be added to the electronic device 10 described below.

As shown in FIG. 1, the electronic device 10 may include a first substrate 102*a* and a plurality of electronic units 100 disposed on the first substrate 102*a*. In accordance with some embodiments, the electronic device 10 may include an antenna device, a display device (e.g., a liquid-crystal display (LCD)), a light-emitting device, a detecting device, or another device for modulating electromagnetic waves, but it is not limited thereto. In some embodiments, the electronic device 10 may be an antenna device, and the electronic unit 100 may be an antenna unit for modulating electromagnetic waves (e.g., microwaves). It should be understood that the arrangement of the electronic units 100 is not limited to the aspect shown in FIG. 1. In accordance with some other embodiments, the electronic units 100 may be arranged in another suitable manner.

In some embodiments, the material of the first substrate 102*a* may include, but is not limited to, glass, quartz, sapphire, ceramic, polyimide (PI), liquid-crystal polymer (LCP) materials, polycarbonate (PC), photo-sensitive polyimide (PSPI), polyethylene terephthalate (PET), other suitable substrate materials, or a combination thereof. In some embodiments, the first substrate 102*a* may include a flexible substrate, a rigid substrate, or a combination thereof.

Figure 2A:
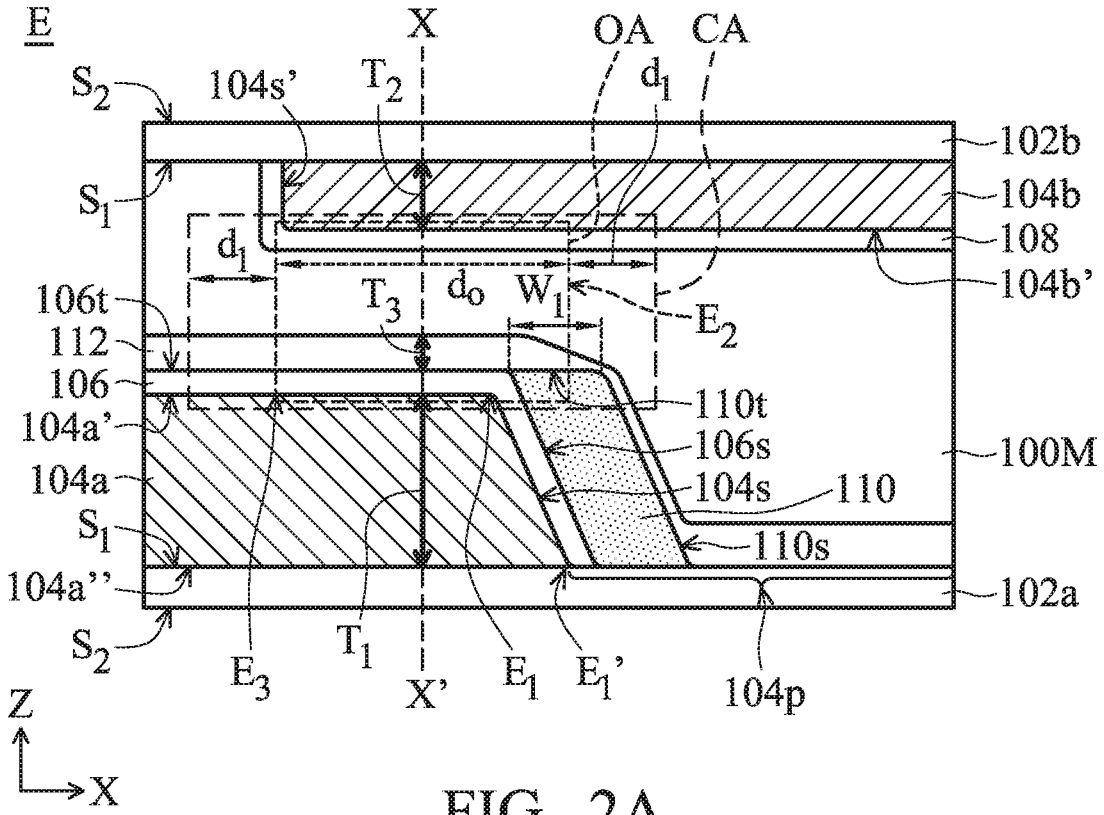
FIG. 2A illustrates the cross-sectional diagram of a portion of the electronic device in accordance with some embodiments of the present disclosure.

Next, refer to FIG. 2A, which illustrates a cross-sectional diagram of a portion of the electronic device 10 in accordance with some embodiments of the present disclosure. Specifically, FIG. 2A illustrates an enlarged cross-sectional diagram of a region E of the electronic unit 100 shown in FIG. 1 in accordance with some embodiments of the present disclosure. As shown in FIG. 2A, the electronic device 10 may include a first substrate 102*a*, a second substrate 102*b*, a first conductive layer 104*a*, and a second conductive layer 104*b*.

The second substrate 102*b* may be disposed opposite to the first substrate 102*a*. In some embodiments, the material of the second substrate 102*b* may include, but is not limited to, glass, quartz, sapphire, ceramic, polyimide (PI), liquid-crystal polymer (LCP) materials, polycarbonate (PC), photo-sensitive polyimide (PSPI), polyethylene terephthalate (PET), other suitable substrate materials, or a combination thereof. In some embodiments, the second substrate 102*b* may include a flexible substrate, a rigid substrate, or a combination thereof. In some embodiments, the material of the second substrate 102*b* may be the same as or different from the material of the first substrate 102*a*.

Moreover, the first conductive layer 104*a* may be disposed on the first substrate 102*a*. Specifically, the first conductive layer 104*a* may be disposed on a first surface $S_1$ of the first substrate 102*a*, and the first surface $S_1$ and a second surface $S_2$ of the first substrate 102*a* are located on opposite sides. In addition, the second conductive layer 104*b* may be disposed on the second substrate 102*b* and located between the first substrate 102*a* and the second substrate 102*b*. Specifically, the second conductive layer 104*b* may be disposed on the first surface $S_1$ of the second substrate 102*b*, and the first surface $S_1$ of the second substrate 102*b* is adjacent to the first substrate 102*a*.

As shown in FIG. 2A, in some embodiments, the first conductive layer 104*a* may have an opening 104*p*, and the opening 104*p* may overlap the second conductive layer 104*b*. In accordance with the embodiments of the present disclosure, the opening 104*p* may be defined as a region that is exposed by the first conductive layer 104*a*. That is, the opening 104*p* may substantially correspond to the region of the first surface $S_1$ of the first substrate 102*a* that is not covered by the first conductive layer 104*a*. region. In some embodiments, the first conductive layer 104*a* may surround the opening 104*p*. In addition, the second conductive layer 104*b* may overlap with the first conductive layer 104*a*. In accordance with some embodiments of the present disclosure, the term "overlap" may include partial overlap or entire overlap in the normal direction of the first substrate 102*a* or the second substrate 102*b* (e.g., the Z direction shown in the figure).

Specifically, in some embodiments, the first conductive layer 104*a* may be patterned to have the opening 104*p*. In some embodiments, the second conductive layer 104*b* may also be patterned to have multiple regions (only a portion of the second conductive layer 104*b* is illustrated in the figure). In some embodiments, multiple regions of the second conductive layer 104*b* may be connected to different circuits.

In some embodiments, the second conductive layer 104*b* may be electrically connected to a functional circuit (not illustrated). The functional circuit may include active components (e.g., thin film transistors and/or chips) or passive components. In some embodiments, the functional circuit may be located on the first surface $S_1$ of the second substrate 102*b* as the second conductive layer 104*b*. In some other embodiments, the functional circuit may be located on the second surface $S_2$ of the second substrate 102*b*, and the functional circuit may be electrically connected to the second conductive layer 104*b*, for example, through a via hole (not illustrated) that penetrates the second substrate 102*b*, a flexible circuit board, or another suitable method for electrical connection, but it is not limited thereto.

In some embodiments, the first conductive layer 104*a* and the second conductive layer 104*b* may include a conductive metal material. In some embodiments, the materials of the first conductive layer 104*a* and the second conductive layer 104*b* may include, but are not limited to, copper, silver, tin, aluminum, molybdenum, tungsten, gold, chromium, nickel, platinum, copper alloy, silver alloy, tin alloy, aluminum alloy, molybdenum alloy, tungsten alloy, gold alloy, chromium alloy, nickel alloy, platinum alloy, other suitable conductive materials or a combination thereof.

Moreover, the first conductive layer 104*a* may have a thickness $T_1$, and the second conductive layer 104*b* may have a thickness $T_2$. In some embodiments, the thickness $T_1$ of the first conductive layer 104*a* may be in a range from 0.5 micrometers (μm) to 4 micrometers (μm) (i.e. 0.5 μm≤the thickness $T_1$≤4 μm), from 1 μm to 3.5 μm, or from 1.5 μm to 3 μm, for example, 2 μm or 2.5 μm. In some embodiments, the thickness $T_2$ of the second conductive layer 104*b* may be in a range from 0.5 μm to 4 μm (i.e. 0.5 μm≤the thickness $T_2$≤4 μm), from 1 μm to 3.5 μm, or from 1.5 μm to 3 μm, for example, 2 μm or 2.5 μm. Furthermore, the thickness $T_1$ of the first conductive layer 104*a* may be the same as or different from the thickness $T_2$ of the second conductive layer 104*b*.

It should be understood that, in accordance with the embodiments of the present disclosure, the "thickness" of the first conductive layer 104*a* refers to the thickness of the first conductive layer 104*a* in any section line X-X' on the median line of an overlapping region OA (which will be described in detail as below) of the first conductive layer 104*a* and the second conductive layer 104*b*. The section line X-X' is substantially parallel to the normal direction of the first substrate 102*a* or the second substrate 102*b* (for example, the Z direction shown in the figure).

Specifically, the median line is formed by using a first edge E1' of a bottom surface 104 *a*' of the first conductive layer 104*a* as a first end and using a third edge E3 of a top surface 104*a*' as the other end, and connecting the points that are apart the two ends from the same distance. The first edge E1' is formed by connecting the points on the bottom surface 104*a*" of the first conductive layer 104*a* that are nearest to the opening 104*p*. On the other hand, the third edge E3 is formed by connecting the points on the top surface 104*a*' that are away from the opening 104*p* and overlapped with the edge of the second conductive layer 104*b* (in the normal direction of the first substrate 102*a* or the second substrate 102*b*). In accordance with some embodiments, the third edge E3 may correspond to an outer edge of the overlapping region OA. In accordance with the embodiments of the present disclosure, the thickness $T_2$ of the second conductive layer 104*b* also refers to the thickness on the segment line X-X' as defined above.

Furthermore, in accordance with the embodiments of the present disclosure, the distance of each component may be measured by using an optical microscopy (OM), or another suitable method. The thickness of each component may be measured by using a scanning electron microscope (SEM), a film thickness profiler (α-step), an ellipsometer, or another suitable method. Specifically, in some embodiments, a minimum distance between the first edge E1' and the third edge E3 as defined above (for example, the distance d0 as shown in the figure) may be measured using an optical microscope, and then based on the first edge E1', the distance apart from the first edge E1' by a distance of one-half the distance d0 (½×d0) (i.e., the position of the median line of the overlapping region OA) may be calculated. In some embodiments, a modulating material 100M may be removed after the substrates are broken, and the cutting is substantially along the Y direction. For example, in the embodiment shown in FIG. 2B, the substrates can be cut along the line segment A-A', and the second substrate 102*b* that is cut can be observed by using a scanning electron microscope. The cross-sectional image of the structure as shown in FIG. 2A can be obtained. The first edge E1' can be found in the image, and the thickness of each element at a position ½×d0 from the first edge E1' in the Z direction in the image can be measured.

In some embodiments, the first conductive layer 104*a* and the second conductive layer 104*b* may be formed by one or more deposition processes, photolithography processes, or etching processes. In some embodiments, the deposition process may include, but is not limited to, a chemical vapor deposition process, a physical vapor deposition process, an electroplating process, an electroless plating process, another suitable process, or a combination thereof. The physical vapor deposition process may include, but is not limited to, a sputtering process, an evaporation process, a pulsed laser deposition and so on. In addition, in some embodiments, the photolithography process may include photoresist coating (e.g., spin coating), soft baking, hard baking, mask aligning, exposure, post-exposure baking, developing the photoresist, rinsing, drying, or another suitable process. In some embodiments, the etching process may include a dry etching process, a wet etching process, or another suitable etching process.

Moreover, as shown in FIG. 2A, the electronic device 10 may further include a first insulating structure 106. The first insulating structure 106 may be disposed on the first conductive layer 104*a* so that the first conductive layer 104*a* may be located between the first substrate 102*a* and the first insulating structure 106. In addition, the first insulating structure 106 may at least partially overlap the top surface 104*a*' and a side surface 104*s* of the first conductive layer 104*a*.

In addition, in some embodiments, the electronic device 10 may further include a second insulating structure 108.

The second insulating structure 108 may be disposed on the second conductive layer 104*b* so that the second conductive layer 104*b* is located between the second substrate 102*b* and the second insulating structure 108. Moreover, the second insulating structure 108 may at least partially overlap a top surface 104*b*' and a side surface 104*s*' of the second conductive layer 104*b*. In addition, the first insulating structure 106 and the second insulating structure 108 each may have a multi-layered structure or a single layer structure.

In some embodiments, the first insulating structure 106 may at least partially extend on the first surface $S_1$ of the first substrate 102*a*. In some embodiments, the second insulating structure 108 may at least partially extend on the first surface $S_1$ of the second substrate 102*b*.

In some embodiments, the first insulating structure 106 and the second insulating structure 108 may include an insulating material. In some embodiments, the first insulating structure 106 and the second insulating structure 108 may include, but are not limited to, an organic material, an inorganic material, or a combination thereof. The organic material may include, but is not limited to, polyethylene terephthalate (PET), polyethylene (PE), polyethersulfone (PES), polycarbonate (PC), polymethylmethacrylate (PMMA), polyimide (PI), photo-sensitive polyimide (PSPI) or a combination thereof. The inorganic material may include, but is not limited to, silicon nitride, silicon oxide, silicon oxynitride or a combination thereof.

The material of the first insulating structure 106 may be the same as or different from the material of the second insulating structure 108. In addition, in the embodiments in which the first insulating structure 106 or the second insulating structure 108 has a multi-layered structure, the materials of the layers may be the same or different.

In some embodiments, the first insulating structure 106 and the second insulating structure 108 may be formed by a chemical vapor deposition process, a sputtering process, a coating process, a printing process, or another suitable process, or a combination thereof. Furthermore, the first insulating structure 106 and the second insulating structure 108 may be patterned by one or more photolithography processes and etching processes.

In addition, the electronic device 10 may include a modulating material 100M disposed between the first conductive layer 104*a* and the second conductive layer 104*b*. In accordance with some embodiments, a material that can be adjusted to have different properties (e.g., dielectric constants) by applying an electric field or another means can be used as the modulating material 100M. In some embodiments, the transmission direction of the electromagnetic signals through the opening 104*p* may be controlled by applying different electric fields to the modulating material 100M to adjust the capacitance.

In some embodiments, the modulating material 100M may include, but is not limited to, liquid-crystal molecules (not illustrated) or microelectromechanical systems (MEMS). For example, in some embodiments, the electronic device 10 may include an electromagnetic element that can be used to emit or receive electromagnetic signals or a MEMS-based antenna unit, but it is not limited thereto. In accordance with some embodiments, the modulating material 100M may include a liquid-crystal layer.

Specifically, in some embodiments, the functional circuit described above may apply a voltage to the second conductive layer 104*b*, and change the properties of the modulating material 100M between the first conductive layer 104*a* and the second conductive layer 104*b* by an electric field that is generated between the first conductive layer 104*a* and the second conductive layer 104*b*. Furthermore, the functional circuit may also apply another voltage to the first conductive layer 104*a*, but it is not limited thereto. In some other embodiments, the first conductive layer 104*a* may be electrically floating, grounded, or connected to another functional circuit (not illustrated), but it is not limited thereto.

It should be understood that one with ordinary skill in the art may adjust the number, shape or arrangement of the first conductive layer 104*a*, the second conductive layer 104*b* and the corresponding opening 104*p* according to needs, and they are not limited to the aspect illustrated in the figure.

In addition, as shown in FIG. 2A, the electronic device 10 may include a buffer layer 110 disposed in the opening 104*p*, and the buffer layer 110 may be adjacent to the overlapping region OA of the first conductive layer 104*a* and the second conductive layer 104*b*. In some embodiments, the buffer layer 110 may be in contact with a side surface 106*s* of the first insulating structure 106 and the first surface $S_1$ of the first substrate 102*a*, and the buffer layer 110 may extend from the side surface 106*s* of the first insulating structure 106 toward the opening 104*p*. Since an alignment layer 112 subsequently formed on the buffer layer 110 has fluidity before the drying process, the buffer layer 110 may serve as a buffer region of the alignment layer 112. For example, the overflow of the alignment layer 112 may be reduced, thereby the thickness uniformity of the alignment layer 112 in the overlapping region OA may be maintained.

Furthermore, in some embodiments, a top surface 110*t* of the buffer layer 110 may be substantially aligned with a top surface 106*t* of the first insulating structure 106. In some other embodiments, the buffer layer 110 may extend partially over the top surface 106*t* of the first insulating structure 106. That is, the top surface 110*t* may not be aligned with the top surface 106*t*.

In some embodiments, a width $W_1$ of the buffer layer 110 may be in a range from 3 μm to 100 μm (i.e. 3 μm≤the width $W_1$≤100 μm), from 5 μm to 80 μm, or from 7 μm to 50 μm, for example, 10 μm, 20 μm, 30 μm, or 40 μm. Specifically, the width $W_1$ of the buffer layer 110 refers to the width of the top surface 110*t* of the buffer layer 110. In addition, in accordance with the embodiments of the present disclosure, the width may be defined as the average of three widths obtained in three separate measurements.

It should be noted that if the width $W_1$ of the buffer layer 110 is too large (for example, greater than 500 μm), the performance of the electronic device 10 to transmit electromagnetic signals may be affected. On the contrary, if the width $W_1$ of the buffer layer 110 is too small (for example, less than 3 μm), the effect of reducing the overflow of the alignment layer 112 may be poor.

In some embodiments, the buffer layer 110 may include an insulating material. In some embodiments, the material of the buffer layer 110 may include an organic material, an inorganic material, or a combination thereof, but it is not limited thereto. The organic material may include, but is not limited to, polyethylene terephthalate (PET), polyethylene (PE), polyethersulfone (PES), polycarbonate (PC), polymethylmethacrylate (PMMA), isoprene, phenol-formaldehyde resin, benzocyclobutene (BCB), perfluorocyclobutane (PECB), or a combination thereof. The inorganic material may include, but is not limited to, silicon nitride, silicon oxide, silicon oxynitride or a combination thereof.

In some embodiments, the buffer layer 110 may have a single layer structure. In some other embodiments, the buffer layer 110 may have a plurality of sublayers. In the embodiments where the buffer layer 110 has a plurality of sublayers, the materials of the sublayers may be the same or different.

In some embodiments, the buffer layer 110 may be formed by a chemical vapor deposition process, a sputtering process, a coating process, a printing process, another suitable process, or a combination thereof. Furthermore, the buffer layer 110 may be patterned by one or more photolithography processes and etching processes.

In addition, as described above, the electronic device 10 may include the alignment layer 112. The alignment layer 112 may be disposed between the first conductive layer 104*a* and the modulating material 100M. Specifically, in some embodiments, the alignment layer 112 may be formed on the first insulating structure 106 and the buffer layer 110 and may further extend on a side surface 110*s* of the buffer layer 110 and in the opening 104*p*. The alignment layer 112 may control the alignment direction of the liquid-crystal molecules in the modulating material 100M.

In some embodiments, the material of the alignment layer 112 may include an organic material, an inorganic material, or a combination thereof. For example, the organic material may include, but is not limited to, polyimide (PI), photoreactive polymer material, or a combination thereof. The inorganic material may include, for example, silicon oxide ($SiO_2$), other material with alignment function, or a combination thereof, but it is not limited thereto. In some embodiments, the alignment layer 112 may be formed by a chemical vapor deposition process, a coating process, a printing process, another suitable process, or a combination thereof. Furthermore, the alignment layer 112 may be patterned by one or more photolithography processes and etching processes.

As described above, since the material of the alignment layer 112 has fluidity, the material of the alignment layer 112 may be cured by a drying process in accordance with some embodiments. Furthermore, in accordance with some embodiments, since the alignment layer 112 that has not been fully cured may flow to the buffer layer 110, a portion of the alignment layer 112 having a relatively uneven thickness (for example, the edge portion) may be mainly formed on the buffer layer 110. With the configuration of the buffer layer 110, the thickness of the alignment layer 112 located in the overlapping region OA of the first conductive layer 104*a* and the second conductive layer 104*b* may be relatively uniform.

In some embodiments, the thickness of at least a portion of the alignment layer 112 in the overlapping region OA may be uniform. The term "uniform" means that the deviation value between the thicknesses of the alignment layer 112 at each position in the overlapping region OA is within a range of ±30%, for example, ±20% or ±10%.

Specifically, in some embodiments, the alignment layer 112 may have a thickness $T_3$ in the overlapping region OA. The thickness $T_3$ also refers to the thickness on the segment line X-X' as defined above. In some embodiments, the thickness $T_3$ of the alignment layer 112 may be in a range from 100 angstroms (Å) to 1500 angstroms (Å) (i.e. 100 Å the thickness $T_3$ 1500 Å), from 300 Å to 1000 Å, or from 500 Å to 900 Å, for example, 600 Å, 700 Å, or 800 Å. In some embodiments, the thickness of the alignment layer 112 at any position in the overlapping region OA is substantially the same as the thickness $T_3$. Moreover, in some embodiments, the difference between the thickness of the alignment layer 112 at any position in the overlapping region OA and the thickness $T_3$ may be in a range less than 50 Å to 1000 Å (i.e. the difference between the thickness of the alignment layer 112 and the thickness $T_3$ 50 Å-1000 Å), or 100 Å to 500 Å.

In addition, it should be understood that, in accordance with the embodiments of the present disclosure, the "overlapping region OA of the first conductive layer 104*a* and the second conductive layer 104*b*" refers to the overlapping region of the bottom surface 104*a*" of the first conductive layer 104*a* and the top surface 104*b*' of the second conductive layer 104*b* in the normal direction of the first substrate 102*a* or the second substrate 102*b* (for example, the Z direction shown in the figure).

Figure 2B:
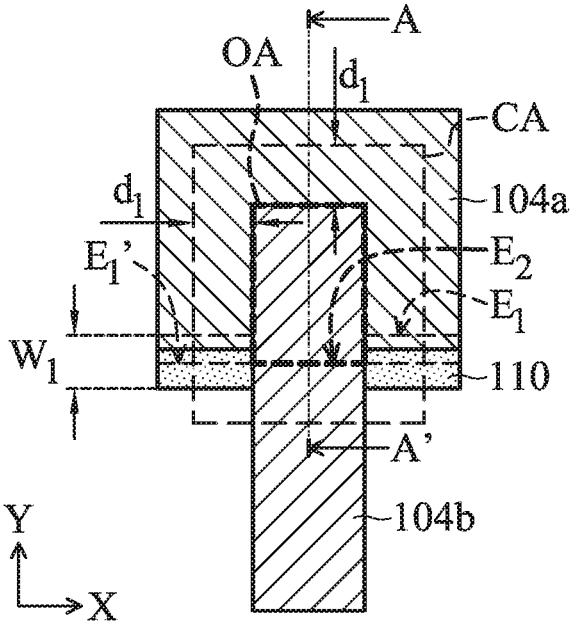
FIG. 2B illustrates the top-view diagram of a portion of the electronic device in accordance with some embodiments of the present disclosure.

In accordance with some embodiments, the overlapping region OA may substantially define a capacitance adjustable region CA. Referring to FIG. 2B at the same time, FIG. 2B illustrates the top-view diagram of a portion of the electronic device 10 in accordance with some embodiments of the present disclosure, and FIG. 2A is the cross-sectional structure along the line segment A-A' in FIG. 2B. It should be understood that only the first conductive layer 104*a*, the second conductive layer 104*b* and the buffer layer 110 are shown in FIG. 2B and other components are omitted for clarity of illustration. Furthermore, only the top surfaces of the second conductive layer 104*b* and the buffer layer 110 are shown in FIG. 2B to illustrate the relationship of positions.

Specifically, the first conductive layer 104*a* and the second conductive layer 104*b* and the modulating material 100M located therebetween may form a capacitor structure. The capacitance adjustable region CA of the capacitor structure may substantially correspond to the overlapping region OA and overlap with the overlapping region OA. However, the area where the electromagnetic signal is actually affected by the capacitance will be larger than the overlapping area OA. In accordance with some embodiments, the capacitance adjustable region CA is defined as an area extending outward from the edge of the overlapping region OA by a first distance $d_1$. In some embodiments, the first distance $d_1$ may be about 1 mm. In some embodiments, the thickness of at least a portion of the alignment layer 112 in the capacitance adjustable region CA may also be uniform.

In addition, as shown in FIG. 2A and FIG. 2B, the overlapping region OA of the first conductive layer 104*a* and the second conductive layer 104*b* may have a second edge $E_2$ adjacent to the opening 104*p*. In some embodiments, the first edge $E_1$' of the bottom surface 104*a*" of the first conductive layer 104*a* may be aligned with the second edge $E_2$ of the overlapping region OA.

In accordance with some embodiments, another buffer layer (not illustrated) may be further disposed between the first substrate 102*a* and the first conductive layer 104*a*, and between the second substrate 102*b* and the second conductive layer 104*b*, so that the expansion coefficient of the first substrate 102*a* and the first conductive layer 104*a* may be matched. The buffer layer may also be used to match the expansion coefficient of the second substrate 102*b* and the second conductive layer 104*b*. In some embodiments, the material of the buffer layer may include, but is not limited to, an organic insulating material, an inorganic insulating material, a metal material, or a combination thereof.

The organic insulating material may include, but is not limited to, an organic compound of acrylic acid or methacrylic acid, an isoprene compound, a phenol-formaldehyde resin, benzocyclobutene (BCB), perfluorocyclobutane (PECB), polyimide, polyethylene terephthalate (PET), or a combination thereof. The inorganic material may include, but is not limited to, silicon nitride, silicon oxide, silicon oxynitride or a combination thereof. The metal material may include, but is not limited to, titanium, molybdenum, tungsten, nickel, aluminum, gold, chromium, platinum, silver, copper, titanium alloy, molybdenum alloy, tungsten alloy, nickel alloy, aluminum alloy, gold alloy, chromium alloy, platinum alloy, silver alloy, copper alloy, another suitable material, or a combination thereof.

In addition, in accordance with some embodiments, the electronic device 10 may further include a spacer element (not illustrated) disposed between the first substrate 102*a* and the second substrate 102*b*. The spacer element may be disposed in the modulating material 100M to enhance the structural strength of the electronic device 10. In some embodiments, the spacer elements may have a ring-shaped structure. In some embodiments, the spacer elements may have columnar structures that are arranged in parallel.

In addition, the spacer element may include an insulating material or a conductive material, or a combination thereof. In some embodiments, the conductive material may include, but is not limited to, copper, silver, gold, copper alloy, silver alloy, gold alloy, or a combination thereof. In some other embodiments, the insulating material may include, but is not limited to, polyethylene terephthalate (PET), polyethylene (PE), polyethersulfone (PES), polycarbonate (PC), polymethylmethacrylate (PMMA), glass or a combination thereof.

Figure 3A:
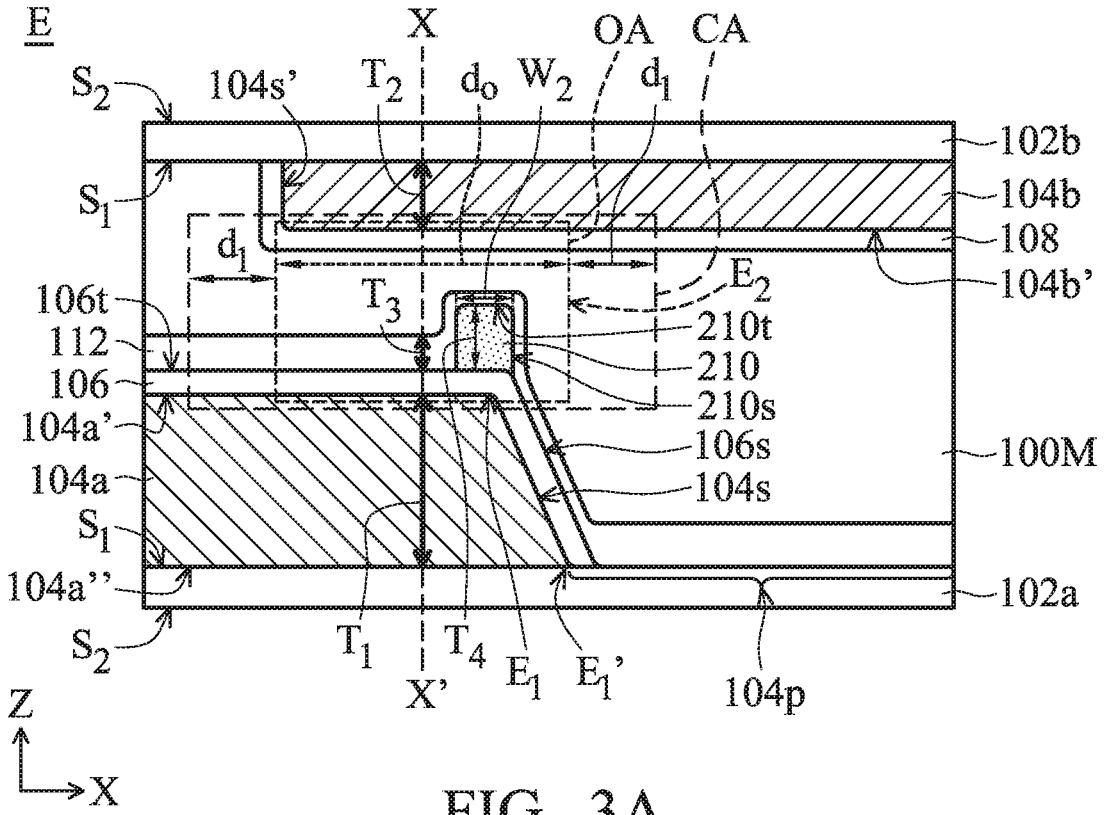
FIG. 3A illustrates the cross-sectional diagram of a portion of the electronic device in accordance with some embodiments of the present disclosure.

Next, refer to FIG. 3A, which illustrates the cross-sectional diagram of a portion of the electronic device 10 in accordance with some other embodiments of the present disclosure. Specifically, FIG. 3A illustrates an enlarged cross-sectional diagram of the region E of the electronic unit 100 shown in FIG. 1 in accordance with some other embodiments of the present disclosure. It should be understood that the same or similar components or elements in above and below contexts are represented by the same or similar reference numerals. The materials, manufacturing methods and functions of these components or elements are the same or similar to those described above, and thus will not be repeated herein.

As shown in FIG. 3A, in this embodiment, the electronic device 10 includes a stopper structure 210 disposed between the first conductive layer 104*a* and the second conductive layer 104*b*. Specifically, the stopper structure 210 may be disposed on the first edge $E_1$ of the top surface 104*a*' of the first conductive layer 104*a*. In some embodiments, the stopper structure 210 may be disposed on the first edge $E_1$' of the bottom surface 104*a*" of the first conductive layer 104*a*. Moreover, the stopper structure 210 may be in contact with the first insulating structure 106 and the alignment layer 112. In some embodiments, the stopper structure 210 may overlap with the first edge $E_1$ of the first conductive layer 104*a* in a normal direction of the first substrate 102*a* or the second substrate 102*b* (e.g., the Z direction shown in the figure). The stopper structure 210 may improve the thickness uniformity of the alignment layer 112 on the first conductive layer 104*a*. In some embodiments, the thickness of at least a portion of the alignment layer 112 in the overlapping region OA is uniform.

It should be understood that although a side surface 210*s* of the stopper structure 210 is substantially aligned with the intersection of the top surface 106*t* and the side surface 106*s* of the first insulating structure 106 in the embodiment shown in FIG. 3A, the side surface 210*s* of the stopper structure 210 may not be aligned with the intersection of the top surface 106*t* and the side surface 106*s* in accordance with some other embodiments. In particular, in some embodiments, the stopper structure 210 may be relatively far from the opening 104*p*, and the side surface 210*s* of the stopper structure 210 may be apart the side surface 106*s* of the first insulating structure 106 by a distance. In some embodiments, the stopper structure 210 may not overlap with the first edge $E_1$ of the first conductive layer 104*a*.

The stopper structure 210 may have a width $W_2$. In some embodiments, the width $W_2$ of the stopper structure 210 may be in a range from 3 μm to 100 μm (i.e. 3 μm≤the width $W_2$≤100 μm), from 5 μm to 80 μm, or from 7 μm to 50 μm, for example, 10 μm, 20 μm, 30 μm, or 40 μm. Specifically, the width $W_2$ of the stopper structure 210 refers to the maximum width of the bottom surface of the stopper structure 210 (i.e. the surface that is in contact with the top surface 106*t* of the first insulating structure 106). It should be noted that if the width $W_2$ is too large (for example, greater than 500 μm), the performance of the electronic device 10 to transmit electromagnetic signals may be affected.

In addition, the stopper structure 210 may have a thickness $T_4$. In some embodiments, the thickness $T_4$ of the stopper structure 210 may be in a range from 0.05 μm to 10 μm (i.e. 0.05 μm≤the thickness $T_4$≤10 μm), from 0.5 μm to 5 μm, or from 0.5 μm to 4 μm. Specifically, the thickness $T_4$ of the stopper structure 210 refers to the maximum thickness of the stopper structure 210 on the first conductive layer 104*a* in the normal direction of the first substrate 102*a* or the second substrate 102*b* (for example, the Z direction as shown in the figure). It should be noted that if the thickness $T_4$ is too large, the cell gap of the electronic device 10 or the performance of transmitting the electromagnetic signals may be affected. On the contrary, if the thickness $T_4$ is too small, the thickness uniformity of the alignment layer 112 may not be effectively improved.

In addition, although the cross-sectional shape of the stopper structure 210 illustrated in the figure is rectangular, the stopper structure 210 may be adjusted to have a suitable shape according to needs in accordance with some other embodiments. For example, in some embodiments, the shape of the stopper structure 210 may include a trapezoid, a triangle, a circle, an ellipse, or an irregular shape and so on, but the present disclosure is not limited thereto.

In some embodiments, the stopper structure 210 may include an insulating material. In some embodiments, the material of the stopper structure 210 may include, but is not limited to, an organic material, an inorganic material, or a combination thereof. The organic material may include, but is not limited to, polyethylene terephthalate (PET), polyethylene (PE), polyethersulfone (PES), polycarbonate (PC), polymethylmethacrylate (PMMA), isoprene, phenol-formaldehyde resin, benzocyclobutene (BCB), perfluorocyclobutane (PECB), or a combination thereof. The inorganic material may include, but is not limited to, silicon nitride, silicon oxide, silicon oxynitride or a combination thereof.

In some embodiments, the stopper structure 210 may have a single layer structure. In some other embodiments, the stopper structure 210 may have a plurality of sublayers. In the embodiments where the stopper structure 210 has a plurality of sublayers, the materials of the sublayers may be the same or different.

In some embodiments, the stopper structure 210 may be formed by a chemical vapor deposition process, a sputtering process, a coating process, a printing process, another suitable process, or a combination thereof. In addition, the stopper structure 210 may be patterned by one or more photolithography processes and etching processes.

Figure 3B:
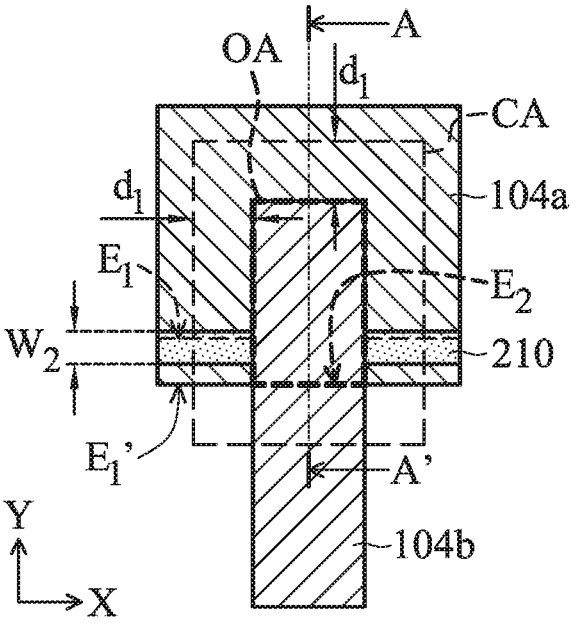
FIG. 3B illustrates the top-view diagram of a portion of the electronic device in accordance with some embodiments of the present disclosure.

Next, please refer to FIG. 3B, which illustrates the top-view diagram of a portion of the electronic device 10 in accordance with some other embodiments of the present disclosure, and FIG. 3A is the cross-sectional structure along the line segment A-A' in FIG. 3B. It should be understood that only the first conductive layer 104*a*, the second conductive layer 104*b* and the stopper structure 210 are shown in FIG. 3B and other components are omitted for clarity of illustration. Furthermore, only the top surfaces of the second conductive layer 104*b* and the stopper structure 210 are shown in FIG. 3B to illustrate the positional relationship.

As shown in FIG. 3B, in some embodiments, the stopper structure 210 may be adjacent to the first edge $E_1$ and the first edge $E_1'$ of the first conductive layer 104*a*. In some embodiments, the stopper structure 210 may overlap with the first edge $E_1$ and/or the first edge $E_1'$ of the first conductive layer 104*a*. The overlapping region OA of the first conductive layer 104*a* and the second conductive layer 104*b* may include a second edge $E_2$ adjacent to the opening 104*p* (not illustrated). In some embodiments, the first edge $E_1'$ of the bottom surface 104*a*" of the first conductive layer 104*a* may be aligned with the second edge $E_2$ of the overlapping region OA.

Figure 4A:
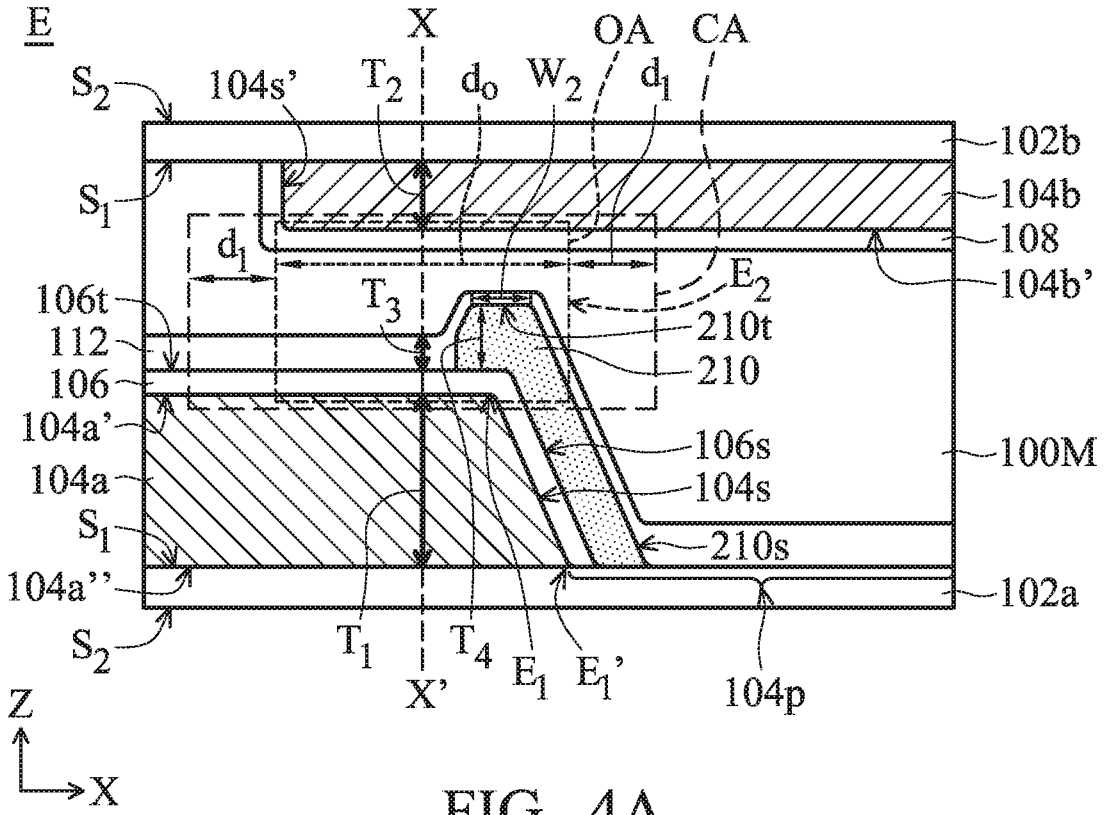
FIG. 4A illustrates the cross-sectional diagram of a portion of the electronic device in accordance with some embodiments of the present disclosure.
Figure 4B:
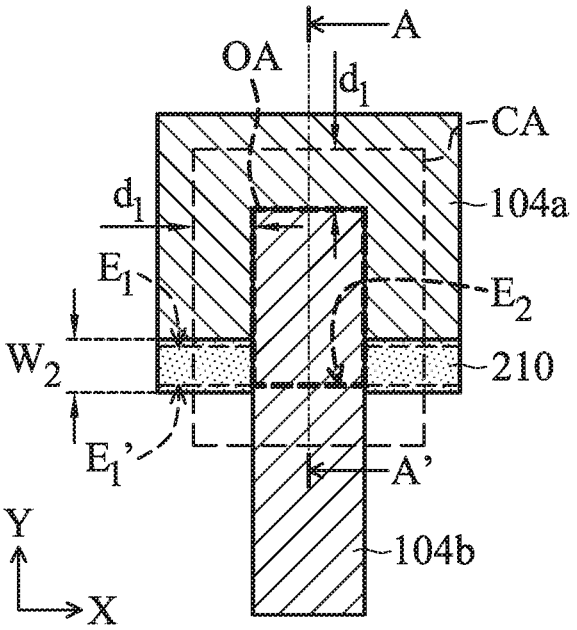
FIG. 4B illustrates the top-view diagram of a portion of the electronic device in accordance with some embodiments of the present disclosure.

Next, refer to FIG. 4A and FIG. 4B, which respectively illustrate the cross-sectional diagram and the top-view diagram of a portion of the electronic device 10 in accordance with some other embodiments of the present disclosure, and FIG. 4A is the cross-sectional structure along the line segment A-A' in FIG. 4B.

The embodiment shown in FIG. 4A is similar to the embodiment shown in FIG. 3A, except that the stopper structure 210 of the electronic device 10 shown in FIG. 4A may further extend on the side surface 106*s* of the first insulating structure 106. Specifically, a portion of the stopper structure 210 may be formed on the top surface 106*t* of the first insulating structure 106, and a portion of the stopper structure 210 may be formed on the side surface 106*s*. In other words, a portion of the stopper structure 210 may be formed in the opening 104*p*.

In this embodiment, the stopper structure 210 may be in contact with the first surface $S_1$ of the first substrate 102*a*. Moreover, in this embodiment, the side surface 210*s* of the stopper structure 210 may not be aligned with the intersection of the top surface 106*t* and the side surface 106*s* of the first insulating structure 106. In addition, as shown in FIG. 4A and FIG. 4B, in some embodiments, a portion of the stopper structure 210 may be located in the capacitance adjustable region CA, and a portion of the stopper structure 210 may be located outside of the capacitance adjustable region CA.

Figure 5A:
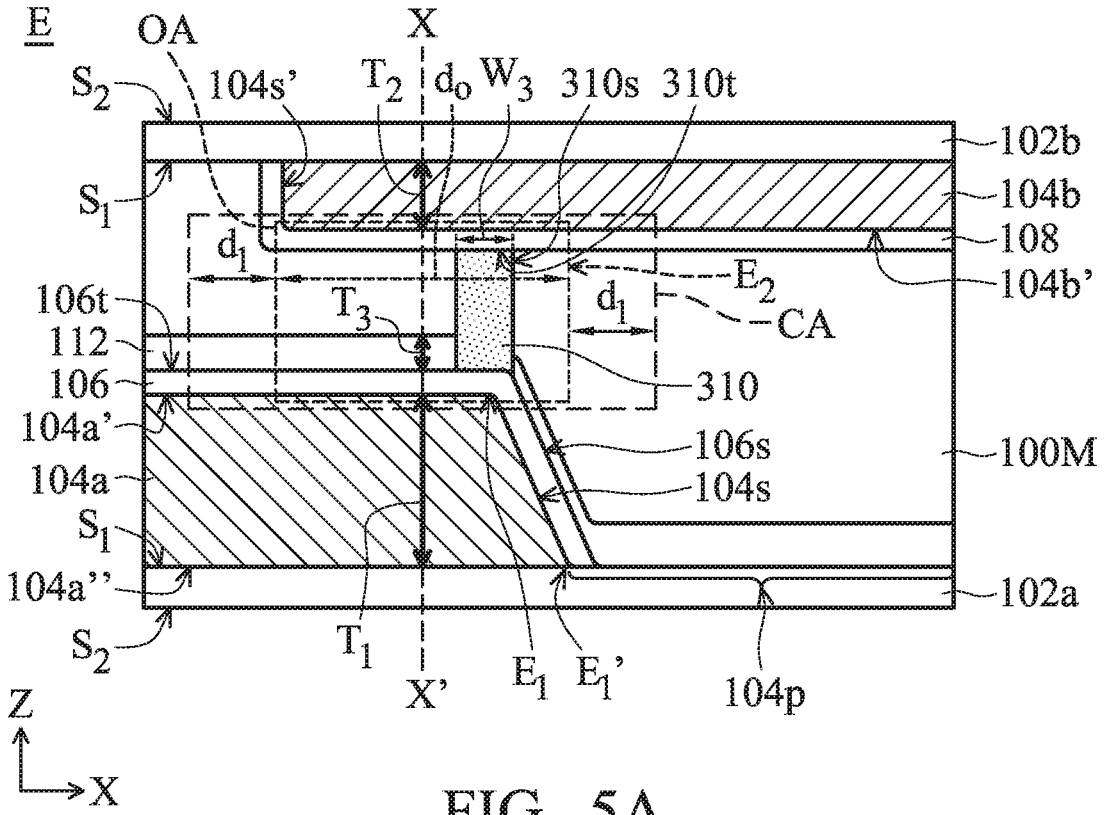
FIG. 5A illustrates the cross-sectional diagram of a portion of the electronic device in accordance with some embodiments of the present disclosure.
Figure 5B:
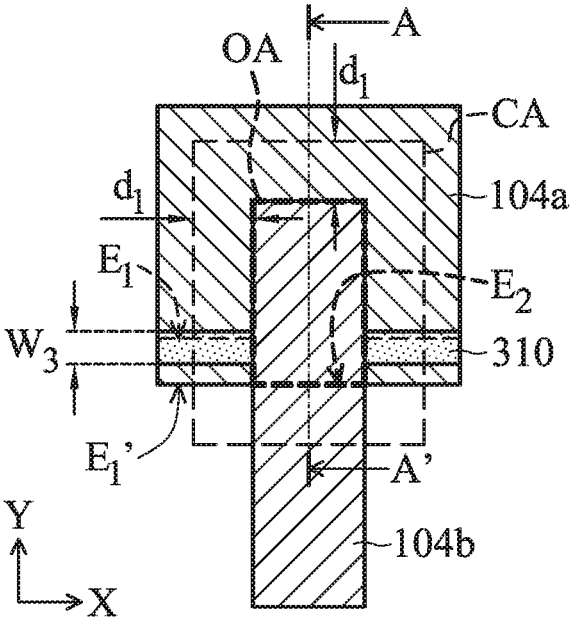
FIG. 5B illustrates the top-view diagram of a portion of the electronic device in accordance with some embodiments of the present disclosure.

Next, refer to FIG. 5A and FIG. 5B, which respectively illustrate the cross-sectional diagram and the top-view diagram of a portion of the electronic device 10 in accordance with some other embodiments of the present disclosure, and FIG. 5A is the cross-sectional structure along the line segment A-A' in FIG. 5B.

The embodiment shown in FIG. 5A is similar to the embodiment shown in FIG. 3A, except that the spacer element 310 may be used as the stopper structure 210 in this embodiment. Specifically, the spacer element 310 may be disposed between the first conductive layer 104*a* and the second conductive layer 104*b*. In some embodiments, the spacer element 310 may penetrate through the alignment layer 112 and be disposed between the first insulating structure 106 and the second insulating structure 108.

In some embodiments, the spacer element 310 may be adjacent to the first edge $E_1$ and the first edge $E_1'$ of the first conductive layer 104*a*. In some embodiments, the spacer element 310 may overlap with the first edge $E_1$ and/or the first edge E1' of the first conductive layer 104*a* in the normal direction of the first substrate 102*a* or the second substrate 102*b* (e.g., the Z direction as shown in the figure). The spacer element 310 may improve the thickness uniformity of the alignment layer 112 on the first conductive layer 104*a*. In some embodiments, the thickness of at least a portion of the alignment layer 112 in the overlapping region OA may be uniform.

It should be understood that the side surface 310*s* of the spacer element 310 is substantially aligned with the intersection of the top surface 106*t* and the side surface 106*s* of the first insulating structure 106 in the embodiment shown in FIG. 5A. However, the side surface 310*s* of the spacer element 310 may not be aligned with the intersection of the top surface 106*t* and the side surface 106*s* in accordance with some other embodiments. In particular, in some embodiments, the spacer element 310 may be further away from the opening 104*p* and may be apart the side surface 106*s* of the first insulating structure 106 from a distance. Alternatively, in some embodiments, the spacer element 310 may be partially disposed on the side surface 106*s* of the first insulating structure 106. In some embodiments, the spacer element 310 may not overlap the first edge $E_1$ of the first conductive layer 104*a*.

Moreover, as shown in FIG. 5A and FIG. 5B, the spacer element 310 may have a width $W_3$. In some embodiments, the width $W_3$ of the spacer element 310 may be in a range from 3 μm to 100 μm (i.e. 3 μm≤the width $W_3$≤100 μm), from 5 μm to 80 μm, or from 7 μm to 50 μm, for example, 10 μm, 20 μm, 30 μm, or 40 μm. Specifically, the width $W_3$ of the spacer element 310 refers to the maximum width of the bottom surface of the spacer element 310 (i.e. the surface that is in contact with the top surface 106*t* of the first insulating structure 106). It should be noted that if the width $W_3$ is too large (for example, greater than 500 μm), the performance of the electronic device 10 to transmit electromagnetic signals may be affected.

As described above, the spacer element 310 may be used as the stopper structure 210. In some embodiments, the spacer element 310 (the stopper structure 210) may include a photo-spacer. In some embodiments, the spacer element 310 may include, but is not limited to, an insulating material, a conductive material, or a combination thereof. The conductive material may include, but is not limited to, copper, silver, gold, copper alloy, silver alloy, gold alloy, or a combination thereof. The insulating material may include, but is not limited to, polyethylene terephthalate (PET), polyethylene (PE), polyethersulfone (PES), polycarbonate (PC), polymethylmethacrylate (PMMA), glass or a combination thereof. In some embodiments, the spacer element 310 may have adhesive properties.

To summarize the above, in the antenna device provided in the embodiments of the present disclosure, with the configuration of the buffer layer, the stopper structure or the spacer element, the thickness uniformity of the alignment layer in the capacitance adjustable region may be improved. Therefore, the antenna device can be provided with the stable capacitance value or operational reliability.

Although some embodiments of the present disclosure and their advantages have been described in detail, it should be understood that various changes, substitutions and alterations can be made herein without departing from the spirit and scope of the disclosure as defined by the appended claims. For example, it will be readily understood by one of ordinary skill in the art that many of the features, functions, processes, and materials described herein may be varied while remaining within the scope of the present disclosure. In addition, the features of the various embodiments can be used in any combination as long as they do not depart from the spirit and scope of the present disclosure. Moreover, the scope of the present application is not intended to be limited to the particular embodiments of the process, machine, manufacture, composition of matter, means, methods and steps described in the specification. As one of ordinary skill in the art will readily appreciate from the present disclosure, processes, machines, manufacture, compositions of matter, means, methods, or steps, presently existing or later to be developed, that perform substantially the same function or achieve substantially the same result as the corresponding embodiments described herein may be utilized according to the present disclosure. Accordingly, the appended claims are intended to include within their scope such processes, machines, manufacture, compositions of matter, means, methods, or steps.

What is claimed is:

1. An antenna device, comprising:

a first substrate;

a first conductive layer disposed on the first substrate, the first conductive layer having an opening;

a second substrate disposed opposite to the first substrate;

a second conductive layer disposed on the second substrate;

a liquid-crystal layer disposed between the first conductive layer and the second conductive layer;

a buffer layer disposed in the opening and adjacent to an overlapping region of the first conductive layer and the second conductive layer; and an alignment layer disposed between the first conductive layer and the liquid-crystal layer, wherein the alignment layer comprises a first portion and a second portion, the first portion overlaps a top surface of the buffer layer in a normal direction of the first substrate, and the second portion overlaps a top surface of the first conductive layer in the normal direction of the first substrate, and wherein a minimum thickness of the first portion is different from a minimum thickness of the second portion.

2. The antenna device as claimed in claim 1, wherein a width of the buffer layer is in a range from 3 micrometers to 100 micrometers.

3. The antenna device as claimed in claim 1, wherein the overlapping region defines a capacitance adjustable region.

4. The antenna device as claimed in claim 1, wherein a thickness of at least a portion of the alignment layer in the overlapping region is uniform.

5. The antenna device as claimed in claim 1, wherein the buffer layer comprises a plurality of sublayers.

6. The antenna device as claimed in claim 1, wherein a thickness of the first conductive layer is in a range from 0.5 micrometers to 4 micrometers.

7. The antenna device as claimed in claim 1, further comprising a first insulating structure disposed on the first conductive layer.

8. The antenna device as claimed in claim 7, wherein the buffer layer is in contact with the first substrate and a side surface of the first insulating structure.

9. The antenna device as claimed in claim 1, wherein the buffer layer comprises an insulating material.

10. The antenna device as claimed in claim 1, wherein a bottom surface of the first conductive layer has a first edge, the overlapping region has a second edge adjacent to the opening, and the first edge is aligned with the second edge.

11. An antenna device, comprising:

a first substrate;

a first conductive layer disposed on the first substrate, the first conductive layer having a first edge;

a second substrate disposed opposite to the first substrate;

a second conductive layer disposed on the second substrate, wherein the first edge is aligned with a second edge of an overlapping region of the first conductive layer and the second conductive layer;

a liquid-crystal layer disposed between the first conductive layer and the second conductive layer;

a stopper structure disposed on the first edge; and an alignment layer disposed between the first conductive layer and the liquid-crystal layer, wherein the alignment layer comprises a first portion and a second portion, the first portion overlaps the stopper structure in a normal direction of the first substrate, and the second portion overlaps a top surface of the first conductive layer and not overlaps the stopper structure in the normal direction of the first substrate, wherein a minimum thickness of the first portion is different from a minimum thickness of the second portion.

12. The antenna device as claimed in claim 11, wherein the overlapping region defines a capacitance adjustable region.

13. The antenna device as claimed in claim 11, wherein a thickness of at least a portion of the alignment layer in the overlapping region is uniform.

14. The antenna device as claimed in claim 11, wherein a width of the stopper structure is in a range from 3 micrometers to 100 micrometers.

15. The antenna device as claimed in claim 11, wherein the stopper structure comprises a plurality of sublayers.

16. The antenna device as claimed in claim 11, wherein a thickness of the first conductive layer is in a range from 0.5 micrometers to 4 micrometers.

17. The antenna device as claimed in claim 11, wherein the stopper structure comprises a photo-spacer.

18. The antenna device as claimed in claim 11, further comprising a first insulating structure disposed on the first conductive layer.

19. The antenna device as claimed in claim 18, wherein the stopper structure is in contact with the first insulating structure and the alignment layer.

20. The antenna device as claimed in claim 18, wherein a portion of the stopper structure is formed on a side surface of the first insulating structure.

* * * * *